United States Patent [19]

Sheiman

[11] Patent Number: 4,617,555

[45] Date of Patent: Oct. 14, 1986

[54] RECEIVER FOR AUDIBLE ALARM

[75] Inventor: Arthur E. Sheiman, Northvale, N.J.

[73] Assignee: Data Distribution Devices, Inc., Closter, N.J.

[21] Appl. No.: 724,024

[22] Filed: Apr. 17, 1985

[51] Int. Cl.[4] ..... G08B 1/00; G10K 11/00

[52] U.S. Cl. ..... 340/531; 340/566; 367/198; 367/199

[58] Field of Search ..... 340/531, 539, 565, 566, 340/384 R, 384 E, 692; 367/197–199

[56] References Cited

U.S. PATENT DOCUMENTS

| | | | |
|---|---|---|---|
| 3,568,144 | 3/1971 | Streb | 367/197 |
| 3,701,103 | 10/1972 | Padgett et al. | 367/199 |
| 3,806,919 | 4/1974 | Comey | 367/197 |
| 3,868,639 | 2/1975 | Okada et al. | 367/197 |
| 4,091,366 | 5/1978 | Lavallee | 340/539 |
| 4,110,725 | 8/1978 | Petrosky | 367/199 |

*Primary Examiner*—Donnie L. Crosland

*Attorney, Agent, or Firm*—Howard Alan Taishoff

[57] ABSTRACT

A receiver to detect the audio tone emitted by an activated smoke alarm. The receiver employs an electret condenser microphone to monitor ambient sound. The output of the microphone is applied to an active bandpass filter and then to a PLL tone decoder. The PLL is tunable to provide maximum sensitivity to the frequency of the tone. The microphone is the gain controllable element in an AGC system that acts to keep received signals at a constant level. This insures that all devices operate linearly.

9 Claims, 4 Drawing Figures

RECEIVER FOR AUDIBLE ALARM

This invention relates to a detector designed to receive the audio signal emitted by an activated smoke alarm.

Many structures are protected by common store-bought smoke alarms. These low cost smoke alarms give off an audible tone in the band of frequencies most audible to the human ear. It has been noted that this band is from approximately 2.5 KHz to 3.5 KHz, and thus most smoke detectors, when triggered, give off an audible tone in this range.

There are many situations in which the audio tone given off by a triggered smoke detector can go unnoticed. For example, these smoke detectors have limited audio power and so their signal can be masked by ambient sounds. Then, too, people can be far enough away from a triggered detector so as not to hear the same. Thus it would be desirable to provide a means for monitoring or receiving the output of a triggered alarm, and to do so reliably.

Many approaches have been taken to deal with this problem. There are patents that describe systems in which the smoke detector is hard wired to a central location. However, such wiring usually involves great expense and there is the danger that the fire will destroy the interconnecting wiring. Then there are patents describing systems in which a plurality of smoke detectors are interconnected to a central station by means of a wireless RF or ultrasonic link. But such wireless systems are prone to interference and require highly sophisticated electronics in their senders and receivers.

Then there are devices designed to receive the audio output of a triggered alarm. The device is placed in proximity to a given smoke detector and when the latter is triggered, the former responds to the emitted audio signal. While such devices appear to have many attributes, they are subject to falsing on ambient noise, or have difficulty detecting the emitted alarm, or both, and this detracts from their suitability as receivers.

The difficulty encountered by devices heretofore designed to detect an audio alarm stems from the type of sound emitted by such alarms and the type of ambient noise encountered. Referring to the sound emitted, many of these low cost smoke alarms were tested. The emitted audio was of the "squeal" type, where squeal designates a high frequency tone in the range of 2.1 KHz to 4.1 KHz. The sonic characteristics of many of the devices showed that the sound may be continuous or pulsating. However, during periods of active sound, the source was essentially sinusoidal (with possible distortion). Referring to ambient noise, these noises were either random phase noises, long term coherent noises, or short term coherent noises.

The present invention overcomes the above-noted problems associated with receivers designed to monitor an audio alarm and provides for a receiver which responds only to the sound emitted by an activated smoke alarm. In general, the present invention is a self-contained audio or sonic receiver which is placed in the vicinity of the smoke detector to be monitored. In its preferred form, the receiver comprises an electret condenser microphone with automatic gain control (AGC), a sharply defined active filter network, and a phase locked loop (PLL) tone decoder. The microphone defines the gain controllable element in the AGC system. Ambient audio is monitored or picked up by the microphone and passed through the filter network. The signal is then sent to a signal amplifier which boosts the same to a 2 volt peak-to-peak level. The AGC circuitry controls the sensitivity of the microphone so that this 2 volt peak-to-peak level is kept relatively constant and not exceeded. The signal is then applied to the PLL tone decoder. The PLL is kept insensitive to sub-harmonics and higher ordered harmonics of the tone being received so that the PLL will discriminate between true smoke detection (i.e., a triggered alarm) and ambient noise. The PLL operates in a narrow band mode and will phase lock onto the tone of a triggered alarm. Once the PLL locks, the output therefrom is used to drive a signaling device such as a telephone dialer or a high-powered alarm.

The PLL decoding of the inventive device, along with sufficient output loop filtering, solves the problems inherent in discriminating from the three types of ambient noise, noted above. The PLL with lock output (quadrature component output, filter, output comparator) in combination with sufficient filtering added to the quadrature output allows the lock indicator to remain locked during periods of pulsating sound.

Random phase components will not cause the PLL to lock so they are eliminated. Long term coherent sources in the inventive receiver's range are eliminated for two reasons. First, the PLL is designed to have a narrrow capture range, approximately 15 percent. Hence the device can be closely tuned to the frequency of a given alarm. Second, in most of the environments measured, most long term sources (usually but not always related to the A.C. power line frequency (60 Hz) or harmonics) were never close enough in frequency to the tone of the alarm because the tone is high pitched.

Finally, short term noise sources do not cause falsing in the inventive device because music and room noise was found to be coherent for only a very short time. Sufficient PLL output filtering is used so that harmonics of any musical notes, or noise, never exist long enough to lock the PLL.

The inventive AGC circuitry helps in the reduction of harmonic generation by keeping all amplifiers and the input to the PLL in their linear regions. The AGC is a special fast attack, slow decay AGC that has superior AGC-loop damping characteristics. By reducing the bias voltage on the electret microphone, the gain of the transducer is reduced substantially. This allows for a very large range of gain reduction at minimal cost. The damping characteristics are quick enough to handle the rapid pulsations of an activated smoke alarm. This allows for maximum receiver sensitivity and a minimum generation of harmonics.

In all environments tested, there was only one common source of noise, which although infrequently a problem, was nevertheless important. Certain telephones with mechanical bells, when placed near to the microphone could have a ring that might sometimes trigger the PLL. Investigation revealed that the bells were of a substantial Q so that, typically, after being rung (driven) for about 2 seconds they would continue to oscillate or ring for up to 4 seconds more, sometimes at the same frequency of a particular alarm. It was found that in these unusual circumstances, an output delay circuit with a relatively long period, longer that the ring cycle (the ring cycle being typically 6 seconds), and a timer with immmediate reset capability would solve the problem. Even with a worst case ring, the PLL would, between rings, always unlock momentarily. This momentary unlock would reset the timer and thus prevent a false alarm. It should noted that some or all of these "anti-ring" techniques, especially the output timer, can be implemented in software if the monitoring device is programmable.

It is therefore an object of the present invention to provide a receiver that responds to the audio output of a triggered smoke alarm.

It is another object of the present invention to provide a receiver that responds to the audio alarm of a common store-bought smoke detector and that does so without falsing or responding to ambient noise.

It is a further object of the present invention to provide a detector for sonic signals that fall within a defined frequency range wherein the detector uses an AGC system to keep signal levels within predetermined limits, and that uses a PLL to discriminate between a true signal and noise.

It is a still further object of the present invention to provide a receiver for sonic signals wherein the receiver is tunable over a narrow band of frequencies thereby allowing the sensitivity of the receiver to be peaked to the tone of a given alarm.

It is another object of the present invention to provide a detector for the tone of a smoke alarm wherein the detector can be supplied as a small self-contained battery operated unit that can be conveniently placed with range of such tone.

Other objects and features of the present invention will become apparent from the following detailed description considered in connection with the accompanying drawings. It is to be understood, however, that the drawings are designed for purposes of illustration only and not as a definition of the limits of the invention for which reference should be made to the appending claims.

In the drawings, wherein the same reference numeral denotes the same element throughout the several figures.

Figure 1:
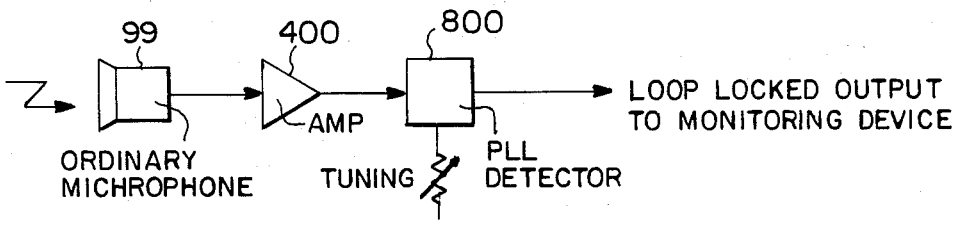
FIG. 1 is a block diagram of a basic or stripped-down version of the inventive receiver.

In detail now and referring now to the drawings, FIG. 1, shows a block diagram of the basic detection system according to the inventive design. In this simplest system, sound is picked up by an ordinary low cost dynamic or piezoelectric microphone 99. The microphone output is applied to a signal amplifier 400 which boosts the signal level a predetermined amount. The output of amplifier 400 is fed to a PLL detector 800. The exact configuration of amplifier 400 and PLL 800 is discussed in detail below, with reference to FIGS. 2 and 3. Suffice it to say here, however, that the PLL is tunable over a relatively narrow range thus allowing the same to be tuned the frequency of the tone from the detector being monitored.

As will be explained below, the PLL lock output is filtered to allow for detection of pulsating smoke alarms and rejection of false signals. Tuning is accomplished by a single adjustment of the VCO (voltage controlled oscillator section of PLL). In all embodiments of the present invention, when the PLL locks onto the monitored alarm tone, the output of the PLL gives a defined response to such lock by going to a logic low (voltage near ground), or if desired, some other predetermined state. In the embodiment of FIG. 1, the output of the PLL is fed into a monitoring device (for example, an automatic telephone dialer, not shown) triggering the same to indicate the presence of an alarm situation. Common such monitoring devices are digital dialers which call the fire department either directly or through a central monitoring station. Thus the monitoring device or dialer responds indirectly, via activation by the inventive receiver, to the presence of smoke or fire.

Figure 2:
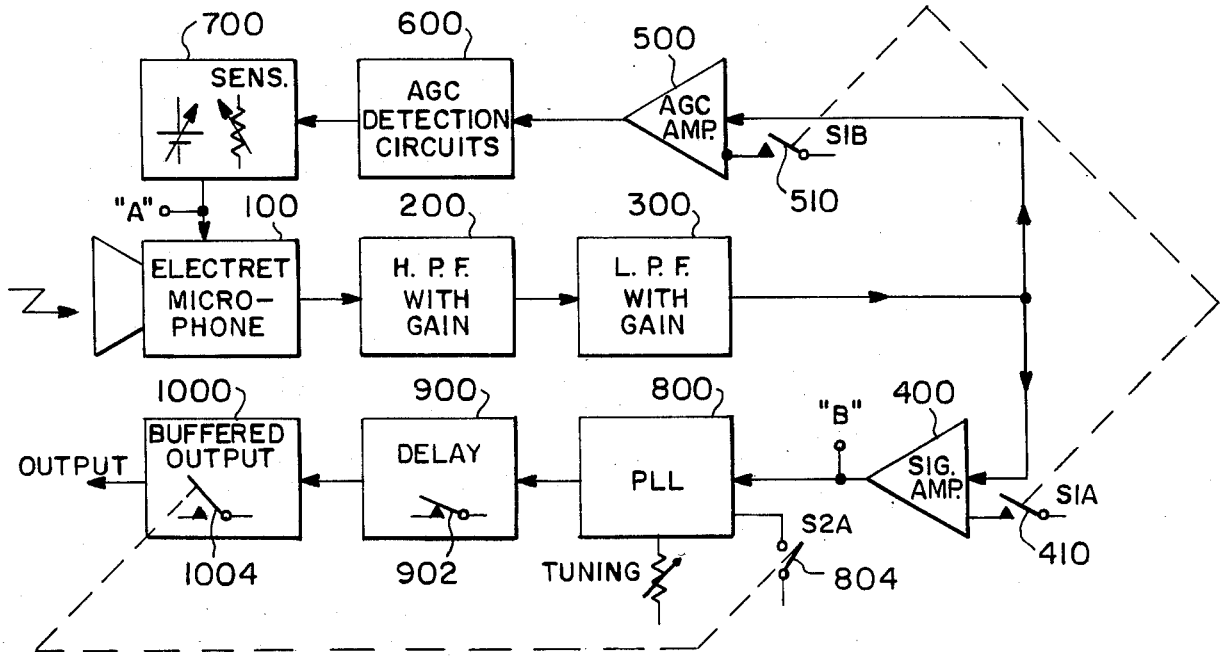
FIG. 2 is a block diagram of an enhanced and preferred form of the inventive receiver.
Figure 3:
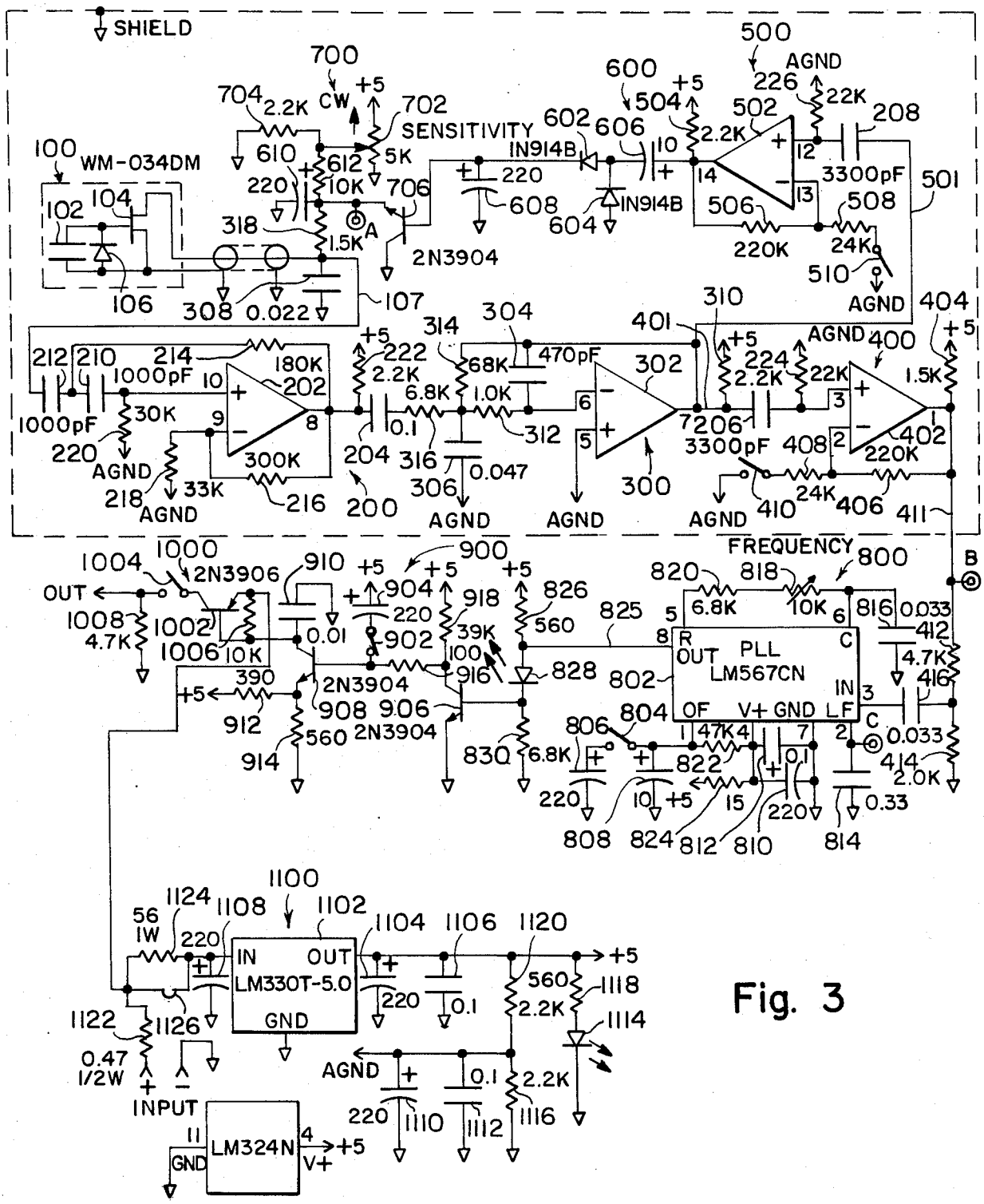
FIG. 3 is a detailed electrical sehematic, with component values listed, of the preferred form of the inventive receiver seen diagrammatically in FIG. 2.

Referring now to FIGS. 2 and 3 there is shown the enhanced and preferred form of the present invention. Sound from a triggered alarm is detected and converted to electrical energy by microphone 100. Microphone 100 is an inexpensive electret condenser microphone with low voltage operation. The microphone should be mounted to the case in which it is held with a sound absorbing cushion to prevent vibrations from the mounting from being mechanically transmitted to the microphone. This prevents strong vibrations from desensitizing the receiver and preventing proper operation. Microphone 100 is supplied as an integral, self-contained unit and includes condenser plates 102 feeding built-in FET amplifier 104 with internally supplied diode 106. FET 104 acts as an impedance converter from the high impedance electret capacitor 102 to the relatively low impedance of a load resistor 318. An electret microphone is chosen because it allows easy gain control by means of an AGC circuit. Note that the DC to the microphone is supplied through resistor 318, more being mentioned about this later in conjunction with the AGC description.

A shielded lead 107 applies the output from microphone 100 to an active high-pass filter 200 where the signal is amplified and filtered. The output of filter 200 is coupled to an active low-pass filter 300 where the signal is, again, amplified and filtered. High-pass filter 200 is followed by low-pass filter 300 to produce an overall response of a relatively wide-band, band-pass filter. This band-pass filter has a low frequency pole of 2.1 KHz and a high frequency pole of 4.1 KHz. Hence, the band-pass filter is realized by a third order Butterworth high-pass filter, with a cut off of 2.1 KHz, followed by a third order low-pass Butterworth filter, with a cut off of 4.1 KHz. Each filter has 20 dB of gain. Placing the high-pass filter section before the low-pass section improves the realization for this application. This is because the primary low frequency components, which make up most of the noise environment, are removed before amplification, thus improving dynamic range. Then the low-pass filter which follows removes high frequency noise to produce a clean output, even for high levels of amplification.

High-pass filter 200 is composed of two parts. A second order stage implemented with op-amp 202, and a first order RC network implemented with capacitor 206 and resistor 224. This last stage is duplicated for AGC amp 502, discussed below, with capacitor 208 and resistor 226. Each chain, either the signal chain or the AGC chain, sees only one of the real poles, and hence each chain sees the same third order filter. The second order section of the high-pass filter is a voltage controlled, voltage source (VCVS) active filter. Although the VCVS filter offers good accuracy without severe restrictions on amplifier gain, 1 percent resistors (resistors 214, 216, 218, 220) and 5 percent capacitors (capacitors 210, 212) are required to insure production stability. Furthermore, the source impedance must be kept low to prevent instability and this is accomplished by resistor 318.

Low-pass filter 300 is also composed of two parts. A second order stage implemented with op-amp 302, and a first order RC network implemented with capacitor 308 and resistor 318. The second order section of the low-pass filter is a multiple feedback (MFB) active filter. 5 percent components will guarantee stability with the MFB filter. Although MFB filters produce severe gain restrictions on the op-amps, the limited gain bandwith product of the second order stage makes this type of filter acceptable here.

Next the signal is split. Part of it is sent to a signal amplifier stage 400 by means of lead 401, and part of it is sent to an AGC amplifier stage 500 by means of lead 501. Each amplifier provides either 0 dB or 20 dB (1X) or 10X of gain for its respective signal path, depending on whether ganged switches 410 and 510 are open or closed. With the switches open, the inventive receiver operates in its low gain (40 dB) mode, and with the switches closed, the receiver operates in its high gain (60 dB) mode.

The AGC path consists of AGC amplifier stage 502, peak detection circuitry 600, and filtering and regulation circuitry 700. Note that the components associated with AGC stage 500 (op-amp 502, resistors 506, 508) are identical with the components associated with signal amplifier stage 400 (op-amp 402, resistors 406, 408), thus these amplifiers have identical characteristics. Capacitor 606 applies the output from amplifier stage 500 to voltage doubling diodes 602 and 604 for peak detection. These diodes should have low dynamic resistance to provide sharp AGC characteristics. The ratio of capacitor 606 divided by capacitor 608 will determine the relative attack time of the AGC response while resistor 612 and capacitor 610 determine the decay time. The decay time is made long enough to allow for pulsating smoke alarms.

When the output of the AGC stage, which mimics the signal amplifier stage, is too large, it turns on transistor 706. This transistor discharges capacitor 610 very rapidly, reducing the voltage at test point "A." This voltage acts as a variable voltage source which supplies the bias to electret microphone 100 via load resistor 318. By reducing the voltage on the electret condenser microphone, the gain of the transducer is reduced. This technique allows the microphone to be the gain controllable stage in the AGC system and provides for wide AGC dynamic range. Transistor 706 is operating in its reverse mode. This is done deliberately to reduce its gain. If the transistor were placed in its normal mode, AGC characteristics as to sharpness, attack time, and decay time, would be about the same. However, AGC dynamic loop response would be highly underdamped. In the inventive technique, AGC action is very nonlinear. This gives rise to its very sharp characteristics, and by using transistor 706 in its low beta reverse mode, damping is improved. It should be noted, too, that using transistor 706 in its reverse mode improves its saturation characteristics. A sensitivity potentiometer 702 is incorporated in the AGC loop. A resistor 704 is added to the center arm of control 702 to give the control a nonlinear characteristic. This improves its controllability. In use and operation, as will be discussed below, it is recommended that major gain reduction be done first with ganged switches 410 and 510, and then with potentiometer 702.

After the signal pases through amplifier stage 400, a lead 411 applies it to PLL stage 800 through a voltage divider made up of resistors 412 and 414. Because of the AGC action noted above, the output of signal amplifier 402, accessible at test point "B," is kept at a nearly constant 2 volt peak-to-peak level. Stage 800 includes a PLL tone decoder 802. This configuration of a PLL utilizes a quadrature detector, output filter, and output comparator for tone detection. The PLL is decoupled from the power supply by resistor 824 and capacitors 810 and 812. The PLL is also placed stragetically with on the board or card (not shown) to prevent feedback. Since the inventive receiver is a very high gain device whose amplifier feeds the PLL directly, care must be taken to insure that the VCO (voltage controlled oscillator) is not fed into the amplifier chain. Otherwise a positive regeneration will occur making the PLL lock up to itself, producing a false alarm. The bandwidth of the PLL is nominally 14 percent, which is small enough to reject false signals, yet large enough to listen for the smoke alarm tone. Capacitor 814, which makes up the loop filter, is chosen to comply with maximum bandwidth operation. Resistors 820, 818, and capacitor 816 comprise the RC section of the VCO. Capacitors 806 and 808 comprise the output filter. Switches 804 and 1004 are ganged and are used to align or tune the PLL to the tone of a given alarm, as discussed below. Opening this ganged switch disables the PLL output while reducing the output time constant dramatically.

To tune the inventive receiver to a tone of a given alarm, the alarm from the smoke detector is momentarily turned on. Switches 804 and 1004 are opened. The PLL is tuned to the particular tone with variable resistor 818. This resistor is preferably of the 20 turn variety. While observing LED 828, variable resistor 818 is slowly swept back and forth, noting its effect on capture range (not lock range). As resistor 818 is swept, first one way, then the other, locking of the PLL is visually observed at two distinct sweep points by LED 828 becoming inactive or shutting off. The wiper arm of resistor 818 is then centered between these two sweep points in the range wherein LED 828 is off.

Once tuned, switches 804 and 1004 are closed. Such closing not only completes the output path from PLL decoder 802, but it connects capacitor 806 to the output filter network of PLL decoder 802. This large capacitor slows the response of the lock and unlock time of the PLL which is important for two reasons. First, the slow response eliminates short transients from producing an output. Second and more important, the long filter constant prevents the PLL output from unlocking during the momentary deactive periods of a pulsating smoke alarm.

A lead 825 applies the output from PLL tone decoder 802 to a delay filter stage 900. Often this delay filter is contained in the monitoring device, in, for example, the automatic telephone dialer. This would emiminate the need of it being in hardware in the inventive receiver. Irrespective of where it is placed, delay stage 900 interposes a relatively long time period of approximately 10 to 12 seconds, with fast reset, before the buffer stage (discussed below) activates the dialer. This 10 or 12 second delay is at least as long as the period of one ring cycle and is accomplished with capacitor 904 and resistor 918.

Under an alarm condition, the capacitor will discharge slowly through resistors 916 and 918 (with the latter resistor comprising almost the entire resistive discharge path) until the voltage at the base of transistor 908 rises enough to turn on the same. The emitter of transistor 908 is applied to a voltage reference, accomplished with resistors 912 and 914. When transistor 908 turns on, it drives an output driver or buffer stage 1000. However, under a no alarm condition and with the delay characteristics exhibited by stage 900, this stage acts as anti-ring interference for certain sounds caused by the ringing of mechanical telephone bells, mentioned earlier. The bell tones may persist long enough to lock the PLL VCO for sufficient time for it to produce a locked signal output. But since these signals usually disappear before the next ring, the PLL will unlock, albeit momentarily. When such unlocking occurs, the output of the PLL will momentarily go high turning on transistor 906. Transistor 906 will rapidly charge capacitor 904 through resistor 916 thus causing an almost instantaneous reset of the timing or delay circuit, i.e., capacitor 904 never discharges sufficiently to turn on transistor 908. It is seen that capacitor 904 is connected to the +5 volt supply and not to ground. This is done so that the capacitor will normally have a voltage impressed across it, with voltage being removed during an alarm situation. If this were not the case, capacitor 904 might degrade with age, and not work properly under an alarm condition. If the characteristics of stage 900 are implemented in software, then the opening of switch 902 will disable the hardware delay of this stage.

The output of delay stage 900 is taken off of the the collector of transistor 908 and directly coupled into the base of output transistor 1002. This last-mentioned transistor is the output driver or buffer, with drive being taken from its collector. Switch 1004, which is in series with the lead from the collector of transistor 1002, is used to isolate the driver from the device being driven, not shown, while the PLL is being tuned, as noted above.

The power supply for the inventive receiver is seen as section 1100. It comprises a low-dropout, three terminal voltage regulator 1102. Regulator 1102 has a +5 volt output and allows for an unregulated input as low as 5.8 volts. This permits economical battery operation. Since a single 5 volt supply is used, op-amp analog ground is derived by voltage divider action and filtering with resistors 1120 and 1116, and capacitors 1110 and 1112. Operation can be either from a 6 volt source or a 12 volt source. With a 12 volt source, jumper 1126 is cut placing resistor 1124 in series with the unregulated voltage input. Capacitors 1104, 1105, and 1108 are for filtering. LED 1114, when lit, indicates that the receiver is "on," but is deleted for battery operation.

Figure 4:
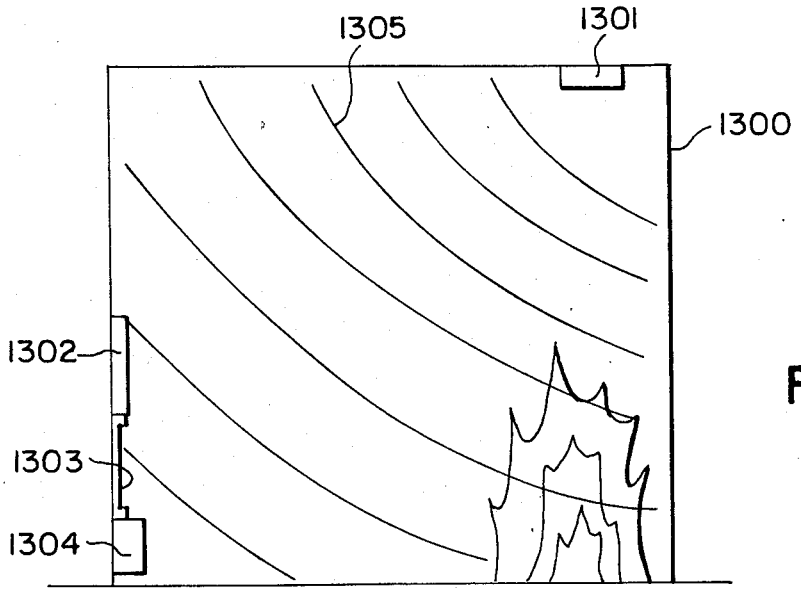
FIG. 4 shows use and operation of the inventive receiver in a building that employs or is protected by a common store-bought smoke detector.

Referring now to FIG. 4, there is shown use of the inventive receiver. Such use should be readily apparent. The room or building being protected, room 1300, employs a conventional smoke detector 1301. The inventive receiver, diagrammatically seen here as being built into a low profile container 1302, is then mounted in the room in any convenient location. It does not have to be placed in line-of-sight with smoke detector 1301.

Microphone 100 is set to its maximum sensitivity by placing the wiper arm of control 702 at the +5 volt side or terminal. Ganged switches 410 and 510 are opened. The alarm tone or signal from detector 1301 is temporarily turned on and a DC voltmeter placed between test point "A" and ground. With this signal, one volt or less should be observed at this test point (Under a no signal condition, test point "A" will be approximately three volts.). If the voltage is substantially greater than one volt, not enough signal is getting to the receiver and switches 410 and 510 should be closed increasing signal gain 20 dB or ten times. In practically all situations, the added gain will drop the voltage at test point "A" to the desired one volt or less. If this does not occur, the receiver should be moved to a spot where sonic pickup is improved. With the voltage at test point "A" at one volt or less, approximately 6 dB of headroom is provided before AGC action is lost or, put another way, before the signal is too weak to provide AGC action. Even when AGC action is lost and microphone 100 is operating at maximum sensitivity (test point "A" would then be at approximately three volts), the inventive receiver will respond to even weaker signals. But, below the AGC limit level (point at which AGC action is lost), the bandwidth of the receiver (PLL) may be reduced.

When the voltage at test point "A" is within proper limits, and with the alarm tone still on, the PLL is then tuned or peaked to the frequency of such tone in the manner stated previously.

An electrical lead 1303 connects the inventive apparatus to, say, an automatic telephone dialer 1304. When detector 1301 is triggered by smoke or fire, sonic energy 1305 from detector 1301 is picked up by the inventive receiver. The receiver locks onto the emitted tone or energy whereupon the output stage of the PLL exhibits a defined response, i.e., it goes low eventually to turn on buffer transistor 1002. Assuming that this buffer transistor is carried in container 1302, a signal from transistor 1002 is sent along lead 1303 causing the dialer automatically to call indicating an alarm situation.

For best results it is recommended that the inventive receiver be sheilded or enclosed in a metal box to prevent electrical noise from causing interference to the high gain amplifier chain. Strong interference may be caused by fluorescent lamps and RF transmitters. Proper shielding eliminates both sources. Sharp transients at harmonics of the 60 Hz power line frequency may cause ringing of the filters if not eliminated by shielding techniques.

In tests outdoors the inventive receiver, when placed in its high gain mode, has picked up the sound and phase locked onto the alarm tone of typical, store-bought smoke detectors from a range as great as 300 feet. But to allow for very poor alarm power from certain detectors, a range of 25 feet is recommended.

With regard to the type of band-pass filter chosen and constructed, other filters such as the Chebychev filter offer superior skirt characteristics. However, the Butterworth third order filter was chosen because it offers only minimal frequency peaking in its component sections. Minimal peaking means improved dynamic range of the amplifiers, which for low voltage, limited gain amplifiers is important. Furthermore, the filter sections being of low individual Q, are easier to systhesize and are more stable. This results in the use of lower cost, higher tolerance components.

The AGC action associated with the inventive AGC system acts to reduce harmonic generation by keeping all amplifiers and the PLL in their linear region. Linear operation improves the sensitivity of the PLL during periods of strong out-of-band noise. Also, note that the associated outputs from amplifiers 202, 302, 402, and 502, have respective pull-up resistors 222, 310, 404 and 504. This greatly reduces distortion and allows for a wider dynamic range.

Electret condenser microphone 100 is manufactured by Panasonic ® (division of Matsushita Electric Corporation) and is listed as part number WM-034DM. Amplifiers 202, 302, 402, and 502, are supplied in one package. This package is an LM 324N quad operational amplifier, and it along with the LM 567CN PLL and the LM 330T-5.0 voltage regulator are manufactured by the National Semiconductor Corporation. However, equivalent parts are supplied by many other companies.

Temperature variations of the entire system (smoke alarm and inventive receiver) should be kept small to reduce drift, especially in the smoke alarm. However, since the system is usually installed in a controlled environment, drift is not a problem.

While only a few embodiments of the present invention have been shown and described, it is to be understood that many changes and modifications can be made hereto without departing from the spirit and scope hereof.

What is claimed is:

1. Apparatus to detect sonic signals within a predetermined range of frequencies comprising an electret microphone with integral FET impedance converter for receiving the sonic signal, band-pass filter means connected to the output of said electret microphone, AGC means connected to the output of said filter means and producing an AGC bias voltage which is applied to the FET to control the sensitivity of said electret microphone, and means connected to the output of said filter means for producing a defined response to the presence of the sonic signal.

2. The apparatus of claim 1, said response producing means comprising a signal amplifier and a PLL, said amplifier connected to the output of said filter means and boosting such output a preset amount, said PLL connected to the output of said amplifier and adapted to lock onto the frequency of the sonic signal and produce the defined response to the presence thereof.

3. The apparatus of claim 2, said PLL being tunable over a narrow frequency range for peaking the response of same to the sonic signal.

4. A receiver to detect the audio tone emitted by an activated smoke alarm comprising transducer means adapted to receive sound energy and converting the same to an electrical signal, band-pass filter means electrically coupled to said transducer means and acting sharply to attenuate electrical signals above and below a defined bandwith, signal amplifier means electrically connected to the output of said filter means for amplifying the electrical signals passed through said filter means, phase locked loop means electrically connected to the output of said amplifier means and adapted to lock onto the amplified electrical signal representing the audio tone and electrically indicate the presence thereof, and means for filtering out the ring of a telephone, the last-mentioned means coupled to the output of said PLL and responsive to the momentary unlocking thereof induced between telephone rings.

5. The receiver of claim 4, AGC means electrically connected to the output of said filter means and adapted to produce a control voltage in response to the signal level at the output of said filter means, the control voltage being applied to said transducer means for controlling the gain thereof thereby tending to keep the last-mentioned output at a constant level.

6. The receiver of claim 5, said transducer means comprising an electret condenser microphone.

7. A receiver for detecting an audio signal that falls within a predetermined range of frequencies comprising microphone means for monitoring the presence of the audio signal, signal amplifier means connected to the output of said microphone means for boosting the output thereof a given amount, phase locked loop tone decoder means coupled to the output of said amplifier means, said tone decoder means adapted to lock onto the audio signal when the same is present at the output of said amplifier means and indicate such presence by a change in state at the output of said tone decoder means, said tone decoder means being tunable over a narrow frequency bend whereby the same can be tuned to the frequency of the audio signal thereby providing maximum sensitivity thereto, and delay means coupled to the output of said tone decoder means, said delay means including a resettable timer that when activated by the output of said tone decoder means has a delay period that is, at least, approximately three seconds long and including nearly instantaneous reset means, the last-mentioned means adapted to reset the timer when said tone decoder means momentarily unlocks.

8. The receiver of claim 7, band-pass filter means interposed between the output of said microphone means and said signal amplifier means, said filter means adapted to pass signals in a predetermined, relatively wide frequency range.

9. The receiver of claim 7, delay means coupled to the output said tone decoder means, said delay means including a resettable timer that when activated by the output of said tone decoder means has a delay period that is at least as long as one ring cycle of a telephone bell and including nearly instantaneous reset means, the last-mentioned means adapted to reset the timer when said tone decoder means momentarily unlocks.

* * * * *